US012295444B2

(12) United States Patent
Gangadhar et al.

(10) Patent No.: US 12,295,444 B2
(45) **Date of Patent: *May 13, 2025**

(54) RATCHET MECHANISM FOR HEAD PROTECTION DEVICE

(71) Applicant: Honeywell Safety Products USA, Inc., Charlotte, NC (US)

(72) Inventors: Durgam Gangadhar, Charlotte, NC (US); Bharat Bhushan Arora, Charlotte, NC (US); Swapnil Gopal Patil, Charlotte, NC (US)

(73) Assignee: Honeywell Safety Products USA, Inc., Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/331,626

(22) Filed: Jun. 8, 2023

(65) Prior Publication Data

US 2023/0309642 A1 Oct. 5, 2023

Related U.S. Application Data

(63) Continuation of application No. 17/152,171, filed on Jan. 19, 2021, now Pat. No. 11,712,082.

(30) Foreign Application Priority Data

Jan. 20, 2020 (IN) ..... 202011002505

(51) Int. Cl.
*A42B 3/14* (2006.01)

(52) U.S. Cl.
CPC ..... *A42B 3/145* (2013.01); *A42B 3/14* (2013.01)

(58) Field of Classification Search
CPC ..... A42B 3/14; A42B 3/145; A42B 3/0406; A42B 3/142; F16H 19/043; F16D 41/18
See application file for complete search history.

(56) References Cited

U.S. PATENT DOCUMENTS 5,357,654 A 10/1994 Hsing-Chi
6,314,588 B1 11/2001 Fang
(Continued)

FOREIGN PATENT DOCUMENTS

CN 101564211 A 10/2009
CN 102245042 A 11/2011
(Continued)

OTHER PUBLICATIONS

U.S. Appl. No. 17/152,171, filed Jan. 19, 2021, 2021-0219647, Allowed.
(Continued)

*Primary Examiner* — Khaled Annis
(74) *Attorney, Agent, or Firm* — Alston & Bird LLP

(57) ABSTRACT

A ratchet mechanism for a hard hat and method of assembling the same are provided. The ratchet mechanism includes a knob with knob protrusions. The ratchet mechanism also includes a ratchet gear. The ratchet gear includes teeth engagement mechanisms. Each teeth engagement mechanism includes a hooking mechanism and a tooth protrusion. Each hooking mechanism is configured to engage with the knob protrusions. The ratchet mechanism also includes a band housing configured to allow a band to ratchetably move within the housing. The band housing also includes a knob engagement protrusion and a ratchet gear aperture configured with one or more teeth defining a ramped surface. The ratchet gear is disposed on the knob engagement protrusion and includes one or more ratchet gear teeth configured to engage with a set of band teeth on the band, such that the rotation of the ratchet gear tightens or loosens the band during operation.

24 Claims, 17 Drawing Sheets

(56) References Cited

U.S. PATENT DOCUMENTS

| | | | |
|---|---|---|---|
| 6,708,376 | B1 | 3/2004 | Landry |
| 6,981,483 | B1 | 1/2006 | Keip |
| 7,000,262 | B2 | 2/2006 | Bielefeld |
| 7,043,772 | B2 | 5/2006 | Bielefeld et al. |
| 7,174,575 | B1 | 2/2007 | Scherer |
| 7,707,695 | B2 | 5/2010 | Dubois |
| 2007/0266481 | A1 | 11/2007 | Alexander et al. |
| 2008/0109947 | A1 | 5/2008 | Dubois |
| 2008/0295229 | A1 | 12/2008 | Fang |
| 2009/0211385 | A1 | 8/2009 | Fiquepron et al. |
| 2010/0050325 | A1 | 3/2010 | Wang-Lee |
| 2010/0095438 | A1 | 4/2010 | Moelker |
| 2010/0170068 | A1 | 7/2010 | Musal |
| 2010/0281604 | A1 | 11/2010 | Grim et al. |
| 2011/0088148 | A1 | 4/2011 | Chen |
| 2011/0289659 | A1 | 12/2011 | Lanez et al. |
| 2011/0299366 | A1 | 12/2011 | Giacobino |
| 2013/0014359 | A1 | 1/2013 | Chen |
| 2015/0059064 | A1 | 3/2015 | Klotz et al. |
| 2015/0059065 | A1 | 3/2015 | Klotz et al. |
| 2015/0107006 | A1 | 4/2015 | Chen |
| 2019/0029885 | A1 | 1/2019 | Seo et al. |
| 2020/0213708 | A1 | 7/2020 | Wang et al. |
| 2020/0288819 | A1 | 9/2020 | Dong |
| 2021/0219647 | A1 | 7/2021 | Gangadhar et al. |

FOREIGN PATENT DOCUMENTS

| | | | |
|---|---|---|---|
| CN | 206197177 | U | 5/2017 |
| CN | 206964100 | U | 2/2018 |
| CN | 207333605 | U | 5/2018 |
| CN | 109210353 | A | 1/2019 |
| EP | 2614737 | A1 | 7/2013 |
| KR | 10-2012-0127814 | A | 11/2012 |
| TW | 507663 | U | 10/2002 |
| WO | 2007/025500 | A1 | 3/2007 |

OTHER PUBLICATIONS

EP Office Action Mailed on Jun. 26, 2024 for EP Application No. 21152200, 4 page(s).
CN Office Action Mailed on Mar. 17, 2021for CN Application No. 202110078274.2, 1 page(s).
EP Office Action Mailed on May 11, 2023 for EP Application No. 21152200, 4 page(s).
European Search Report Mailed on Jun. 14, 2021for EP Application No. 21152200.8, 7 page(s).
Examiner Interview Summary Record (PTOL-413) Mailed on Mar. 13, 2023 for U.S. Appl. No. 17/152,171.
Final Office Action Mailed on Dec. 30, 2022 for U.S. Appl. No. 17/152,171.
IN Office Action Mailed on Nov. 11, 2021for IN Application No. 202011002505, 5 page(s).
Non-Final Office Action Mailed on Sep. 14, 2022 for U.S. Appl. No. 17/152,171.
Notice of Allowance and Fees Due (PTOL-85) Mailed on Jun. 1, 2023 for U.S. Appl. No. 17/152,171, 5 page(s).
Notice of Allowance and Fees Due (PTOL-85) Mailed on Mar. 13, 2023 for U.S. Appl. No. 17/152,171.
CN Office Action Mailed on Jul. 17, 2024 for CN Application No. 202110078274, 5 page(s).
English Translation of CN Office Action dated Jul. 17, 2024 for CN Application No. 202110078274, 7 page(s).
CN Office Action Mailed on Feb. 3, 2024 for CN Application No. 202110078274, 8 page(s).
English Translation of CN Office Action dated Feb. 3, 2024 for CN Application No. 202110078274, 6 page(s).
English translation of CN Search report dated Feb. 3, 2024 for CN Application No. 202110078274, 2 page(s).
European search report Mailed on Jun. 14, 2021 for EP Application No. 21152200, 7 page(s).
Final Rejection Mailed on Dec. 30, 2022 for U.S. Appl. No. 17/152,171, 14 page(s).
Non-Final Rejection Mailed on Sep. 14, 2022 for U.S. Appl. No. 17/152,171, 8 page(s).
IN Hearing Notice Mailed on Feb. 9, 2024 for IN Application No. 202011002505, 2 page(s).
CN Office Action Mailed on Nov. 21, 2024 for CN Application No. 202110078274, 4 page(s).
English Translation of CN Office Action dated Nov. 21, 2024 for CN Application No. 202110078274, 5 page(s).

RATCHET MECHANISM FOR HEAD PROTECTION DEVICE

CROSS-REFERENCE TO RELATED APPLICATIONS

This application claims the benefit of U.S. patent application Ser. No. 17/152,171, filed Jan. 19, 2021, the entire contents of which are incorporated by reference herein. U.S. patent application Ser. No. 17/152,171 claims priority pursuant to 35 U.S.C. 119(a) of Indian Application No. 202011002505, filed Jan. 20, 2020, which application is incorporated herein by reference in its entirety.

TECHNOLOGICAL FIELD

Example embodiments of the present disclosure relate generally to head protection devices, and more particularly, to ratcheting mechanism for head protection devices.

BACKGROUND

Head protection devices need to be properly secured in order to function correctly. Applicant has identified several technical challenges associated with ratcheting systems used for safety equipment. Through applied effort, ingenuity, and innovation, many of these identified challenges have been overcome by developing solutions that are included in embodiments of the present disclosure, many examples of which are described in detail herein.

BRIEF SUMMARY

The illustrative embodiments of the present disclosure relate to ratchet mechanisms for head protection devices. In an example embodiment, a ratchet mechanism for a hard hat is provided. The ratchet mechanism includes a knob with a plurality of knob protrusions. The ratchet mechanism also includes a ratchet gear. The ratchet gear includes a plurality of teeth engagement mechanisms. Each teeth engagement mechanism includes a hooking mechanism and a tooth protrusion. Each hooking mechanism is configured to engage with one of the one or more knob protrusions. The ratchet mechanism also includes a band housing configured to allow a band to ratchetably move within the housing. The band housing includes a knob engagement protrusion and a ratchet gear aperture configured with one or more teeth surrounding the ratchet gear aperture. The teeth define a ramped surface. The ratchet gear is disposed on the knob engagement protrusion and the ratchet gear further includes one or more ratchet gear teeth configured to engage with a set of band teeth on the band, such that the rotation of the ratchet gear tightens or loosens the band during operation.

In some embodiments, each tooth protrusion is configured to engage with one of the one or more teeth of the band housing in an instance in which the ratchet gear is rotated in a specific direction, such that the rotation of the ratchet gear is restricted in an instance in which at least one tooth protrusion is engaged. In some embodiments, the ratchet gear is disposed on the knob engagement protrusion and the ratchet gear further includes one or more ratchet gear teeth configured to engage with a set of band teeth on the band, such that the rotation of the ratchet gear tightens or loosens the band during operation. In some embodiments, each of the teeth engagement mechanism defines a knob protrusion travel area defined between the hooking mechanism and a stopping protrusion. In such an embodiment, the knob protrusion is configured to move within the knob protrusion travel during operation of the ratchet mechanism. In some embodiments, the knob protrusion defines a first position within the knob protrusion travel area and a second position within the knob protrusion travel area. In such an embodiment, at the first position the knob protrusion engages with the stopping protrusion, such that the ratchet gear is rotated in a first direction, and at the second position the knob protrusion engages with the hooking protrusion travel area, such that the ratchet gear is rotated in a second direction and one or more tooth protrusions are disengaged from the one or more teeth surrounding the ratchet gear aperture.

In some embodiments, the number of knob protrusions is the same as the number of teeth engagement mechanisms. In some embodiments, the knob includes four knob protrusions spaced equally along the interior of the knob and the ratchet gear includes four teeth engagement mechanisms. In such an embodiment, each teeth engagement mechanism is configured to engage with one of the knob protrusions. In some embodiments, the knob protrusions are equally spaced from one another. In some embodiments, the knob is configured to operably couple with the knob engagement protrusion. In some embodiments, the band housing is configured to receive two ends of the band, such that the ratchet mechanism is configured to retract one or more ends of the band.

In some embodiments, the one or more teeth are configured around the ratchet gear aperture, such that the lower portion of the ramped surface of one tooth abuts a higher portion of the ramped surface of another tooth. In some embodiments, the tooth protrusion of the ratchet gear is configured to disengage with the teeth of the band housing in an instance a sufficient rotational force is provided. In some embodiments, the rotation of the ratchet gear teeth loosen or tighten the band based on the rotational direction of the ratchet gear, wherein the rotation of the ratchet gear teeth in at least one direction is restricted in an instance in which at least one tooth protrusion is engaged with the one or more teeth of the band housing.

In another example embodiment, a method of assembling a ratchet mechanism for a hard hat is provided. The method includes providing a band housing. The band housing is configured to allow a band to ratchetably move within the housing. The band housing includes a knob engagement protrusion and a ratchet gear aperture configured with one or more teeth surrounding the ratchet gear aperture. The teeth define a ramped surface. The method also includes depositing a ratchet gear within the ratchet gear aperture. The ratchet gear includes a plurality of teeth engagement mechanisms. Each teeth engagement mechanism includes a hooking mechanism and a tooth protrusion. Each hooking mechanism is configured to engage with one of one or more knob protrusions of a knob and each tooth protrusion is configured to engage with one of the one or more teeth of the band housing. The method still further includes coupling the knob to the ratchet mechanism. The knob includes a plurality of knob protrusions.

In some embodiments, each tooth protrusion is configured to engage with one of the one or more teeth of the band housing in an instance in which the ratchet gear is rotated in a specific direction, such that the rotation of the ratchet gear is restricted in an instance in which at least one tooth protrusion is engaged. In some embodiments, the ratchet gear is disposed on the knob engagement protrusion and the ratchet gear further includes one or more ratchet gear teeth configured to engage with a set of band teeth on the band, such that the rotation of the ratchet gear tightens or loosens the band during operation. In some embodiments, each of the teeth engagement mechanism defines a knob protrusion travel area defined between the hooking mechanism and a stopping protrusion. In such an embodiment, the knob protrusion is configured to move within the knob protrusion travel during operation of the ratchet mechanism. In some embodiments, the knob protrusion defines a first position within the knob protrusion travel area and a second position within the knob protrusion travel area. In such an embodiment, at the first position the knob protrusion engages with the stopping protrusion, such that the ratchet gear is rotated in a first direction, and at the second position the knob protrusion engages with the hooking protrusion travel area, such that the ratchet gear is rotated in a second direction and one or more tooth protrusions are disengaged from the one or more teeth surrounding the ratchet gear aperture.

In some embodiments, the number of knob protrusions is the same as the number of teeth engagement mechanisms. In some embodiments, the knob includes four knob protrusions spaced equally along the interior of the knob and the ratchet gear includes four teeth engagement mechanisms. In such an embodiment, each teeth engagement mechanism is configured to engage with one of the knob protrusions. In some embodiments, the knob protrusions are equally spaced from one another. In some embodiments, the knob is configured to operably couple with the knob engagement protrusion. In some embodiments, the band housing is configured to receive two ends of the band, such that the ratchet mechanism is configured to retract one or more ends of the band.

In some embodiments, the one or more teeth are configured around the ratchet gear aperture, such that the lower portion of the ramped surface of one tooth abuts a higher portion of the ramped surface of another tooth. In some embodiments, the tooth protrusion of the ratchet gear is configured to disengage with the teeth of the band housing in an instance a sufficient rotational force is provided. In some embodiments, the rotation of the ratchet gear teeth loosen or tighten the band based on the rotational direction of the ratchet gear. In such an embodiment, the rotation of the ratchet gear teeth in at least one direction is restricted in an instance in which at least one tooth protrusion is engaged with the one or more teeth of the band housing.

The above summary is provided merely for purposes of summarizing some example embodiments to provide a basic understanding of some aspects of the disclosure. Accordingly, it will be appreciated that the above-described embodiments are merely examples and should not be construed to narrow the scope or spirit of the disclosure in any way. It will be appreciated that the scope of the disclosure encompasses many potential embodiments in addition to those here summarized, some of which will be further described below.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION

Some embodiments of the present disclosure will now be described more fully hereinafter with reference to the accompanying drawings, in which some, but not all embodiments are shown. Indeed, the disclosure may be embodied in many different forms and should not be construed as limited to the embodiments set forth herein; rather, these embodiments are provided so that this disclosure will satisfy applicable legal requirements. The terms "or" and "optionally" are used herein in both the alternative and conjunctive sense, unless otherwise indicated. The terms "illustrative" and "exemplary" are used to be examples with no indication of quality level. Like numbers refer to like elements throughout.

The components illustrated in the figures represent components that may or may not be present in various example embodiments described herein such that embodiments may include fewer or more components than those shown in the figures while not departing from the scope of the disclosure.

Turning now to the drawings, the detailed description set forth below in connection with the appended drawings is intended as a description of various example configurations and is not intended to represent the only configurations in which the concepts described herein may be practiced. The detailed description includes specific details for the purpose of providing a thorough understanding of various concepts with like numerals denoting like components throughout the several views. However, it will be apparent to those skilled in the art of the present disclosure that these concepts may be practiced without these specific details.

In many example industrial working environments, such as mining, tunneling, quarrying, ship building, construction, pharmaceutical, heavy industry engineering industry, power industry, and forestry, the risk of head injury to workers is constantly present. Often, head injuries are a result of the impact of a falling object or collision with fixed objects at the workplace. Therefore, safety helmets are often required to help ensure the safety of workers in dangerous conditions. However, current safety helmets may not fit the user correctly or consistently, in some examples, especially during emergency incidents, due to various reasons, including improper placement, unbuckling or loose buckling of chin strap, loosened headband and/or the like. Even when installed correctly on a user, current safety helmets often use ineffective ratcheting means that can loosen during operation due to mechanism failure. In some examples, such failures may be based on defects, wear and tare, and/or the like Various embodiments of the present embodiment allow for a user to easily tighten the ratcheting mechanism using a knob, while also resisting loosening during operation using one or more teeth engagement mechanisms of a specially designed ratchet gear.

Figure 1A:
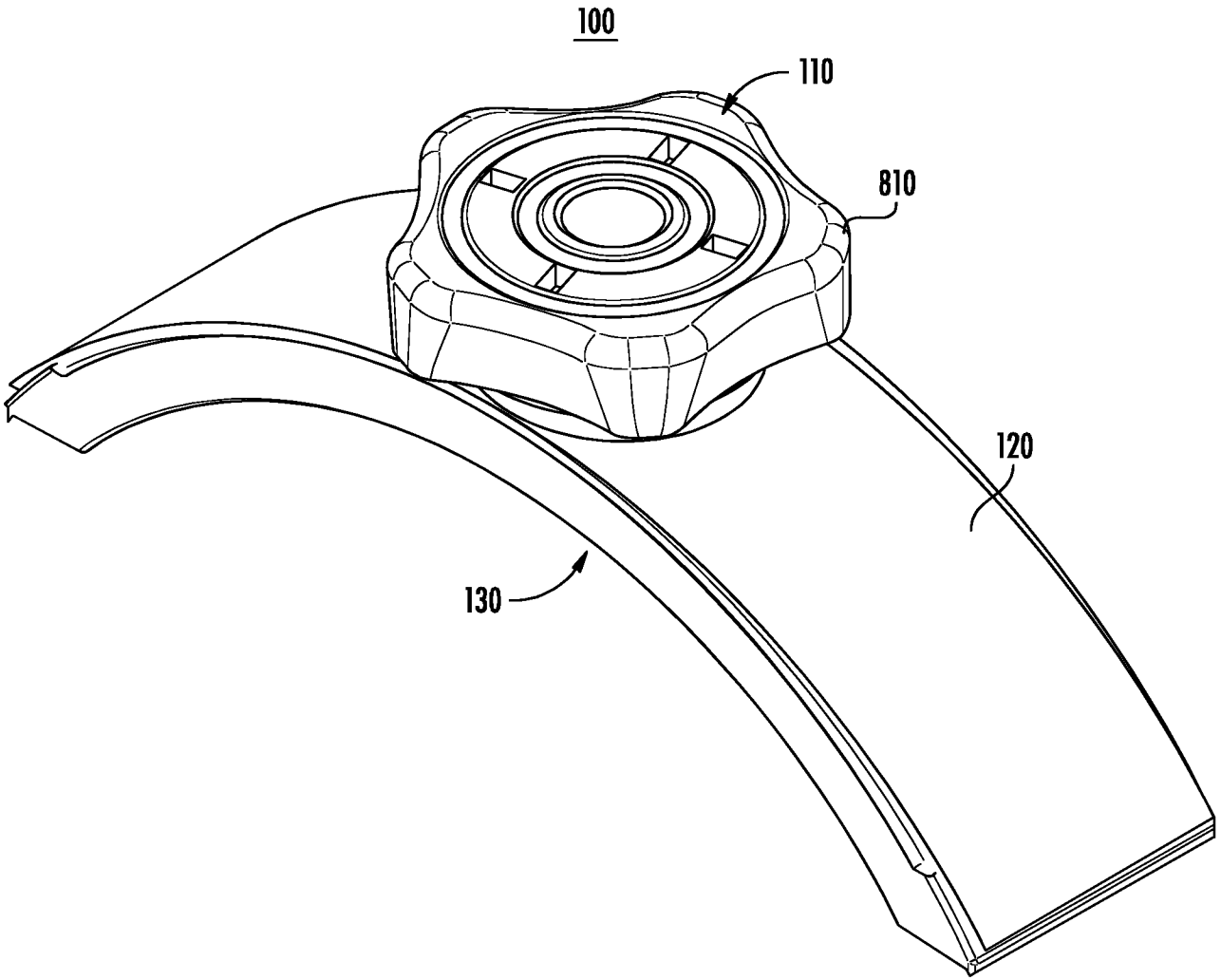
FIGS. 1A-1C illustrate various exterior views of a ratchet mechanism in accordance with an example embodiment of the present disclosure.
Figure 1B:
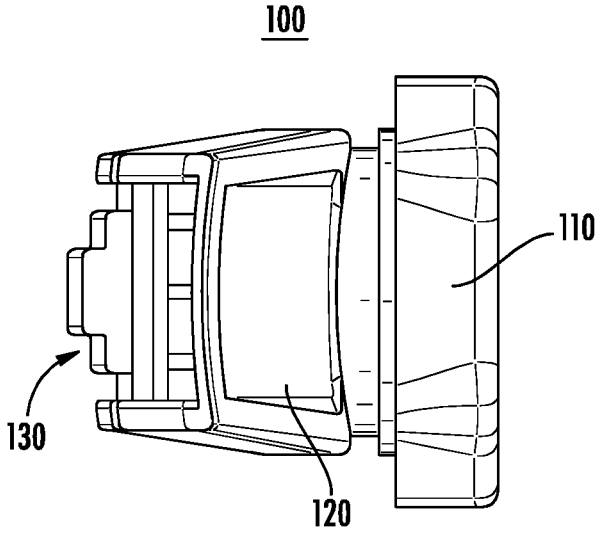
Figure 1C:
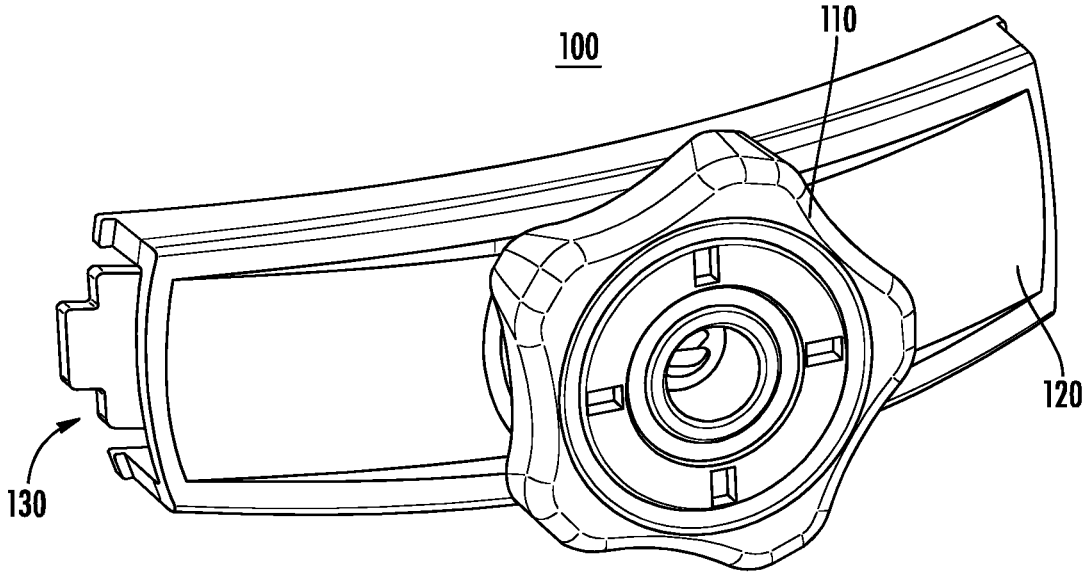

FIGS. 1A-1C illustrate various exterior views of a ratchet mechanism in accordance with an example embodiment of the present disclosure. As shown, the ratchet mechanism 100 may include a knob 110, a band housing (e.g., a top cover 120 snap fit to a bottom cover 130). In various embodiments, the knob 110 may be configured to allow a user to tighten or loosen the ratchet mechanism 100. As such, the knob 110 may be shaped such that the user could easily operate the knob 110. In various embodiments, the knob may have a plurality of engagement protrusions 610 to allow for a user to grip the knob 110. For example, as shown, the knob may have five engagement protrusions 610.

In various embodiments, the knob 110 is operably coupled with the ratchet gear 140 (shown in FIG. 3), as discussed in more detail below. In various embodiments, the top cover 120 and the bottom cover 130 are configured to engage with one another (e.g., via snap-fitting) to form a band housing. In some embodiments, the band housing may define a unitary piece (e.g., the top cover 120 and the bottom cover 130 may be formed out of a singular piece of material). In various embodiments, the band housing (e.g., the top cover 120 and the bottom cover 130) may define a band cavity therein (e.g., between the top cover 120 and the bottom cover 130). In various embodiments, the band cavity may be configured to receive a head band (e.g., head band 150). For example, two ends of the head band may be placed in the band cavity such that the ratchet mechanism is configured to loosen and/or tighten the band such that the head band may fit snuggly with various shaped heads.

Figure 2A:
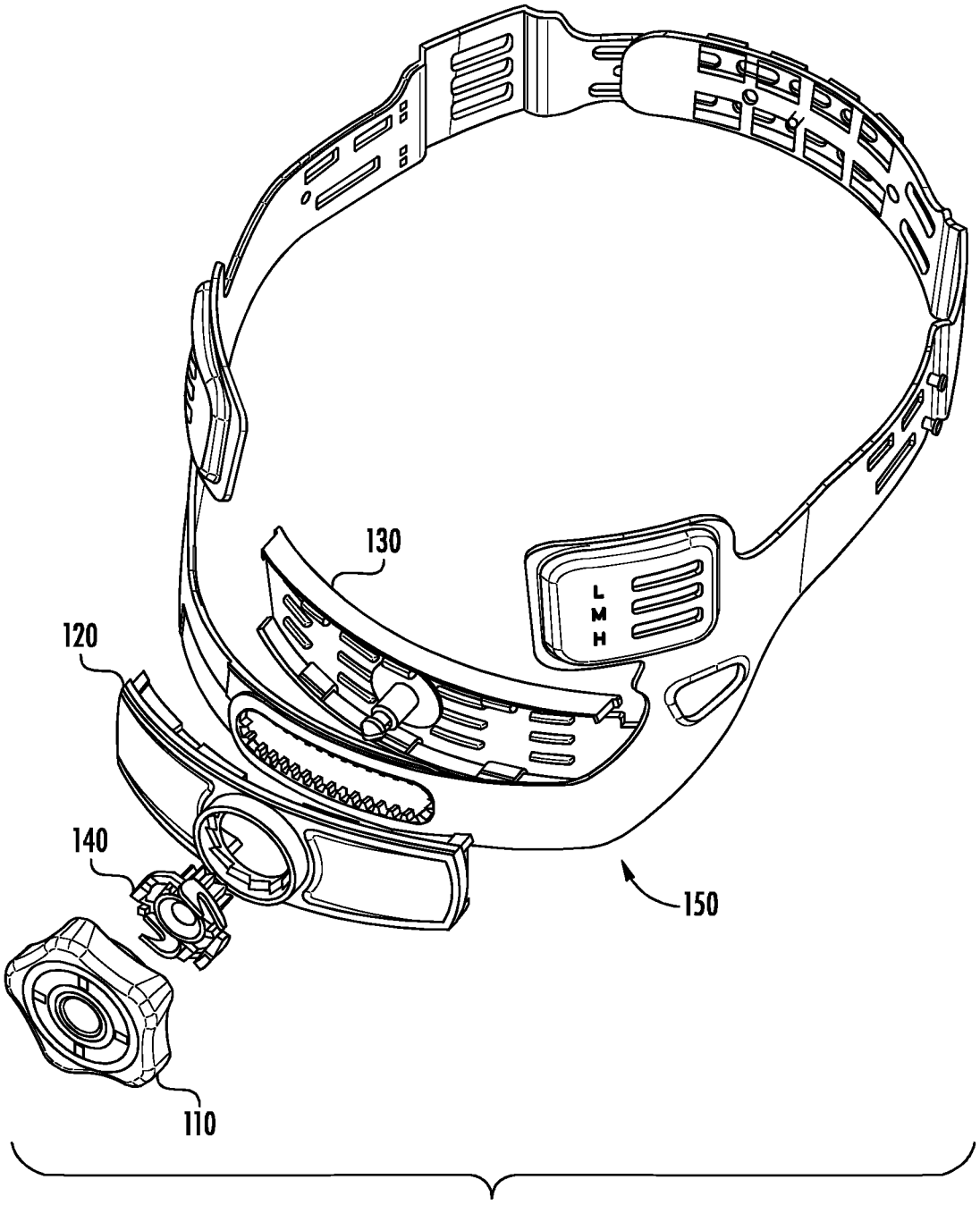
FIGS. 2A and 2B are exploded views of the ratchet mechanism for use with a head band in accordance with an example embodiment of the present disclosure.
Figure 2B:
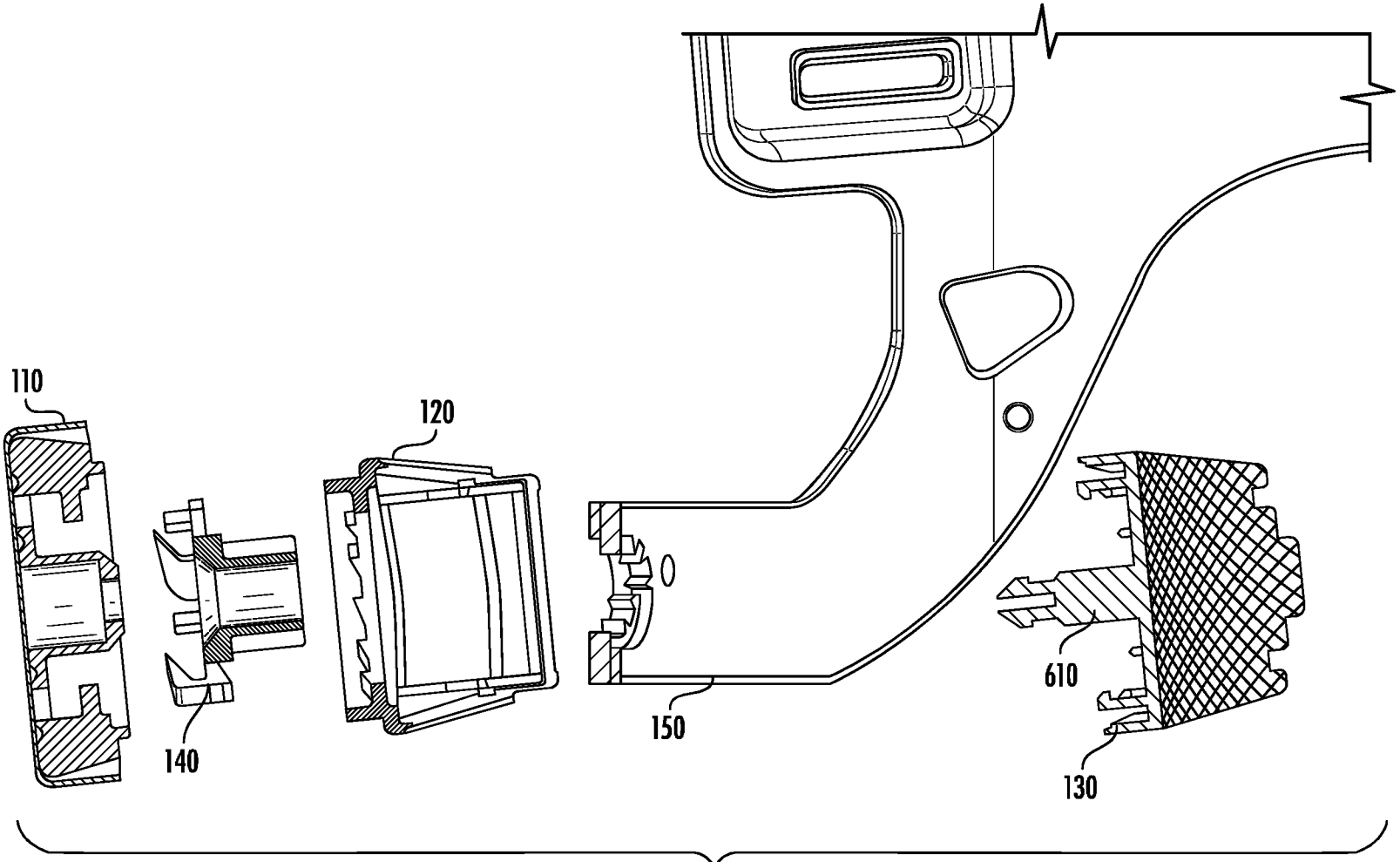
Figure 2C:
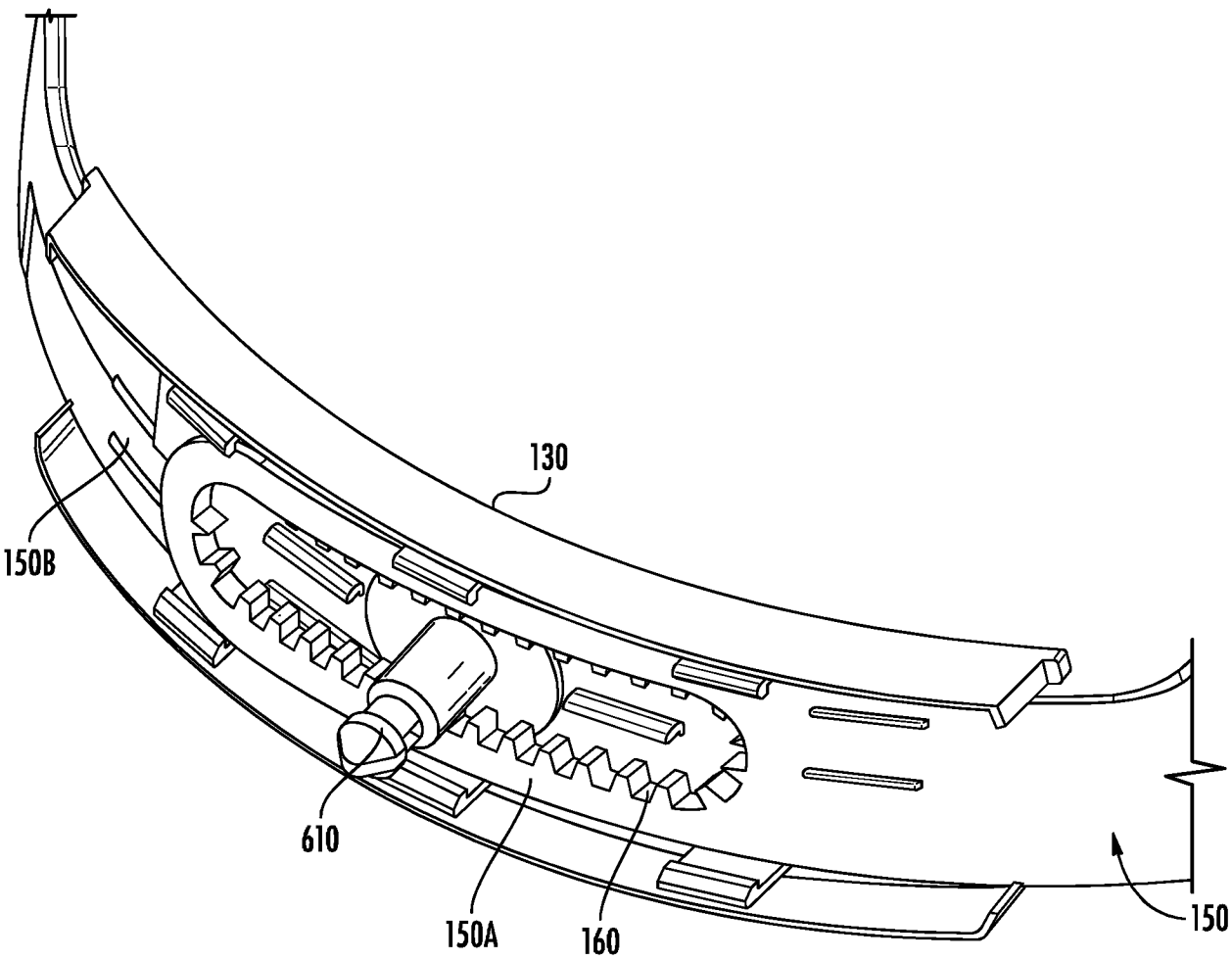
FIG. 2C illustrates the placement of a bottom cover on the head band in accordance with an example embodiment of the present disclosure.

Referring now to FIGS. 2A and 2B, exploded views of the ratchet mechanism are provided as installed on a head band. In some embodiments, the ratchet mechanism 100 may be installed on a head band 150. As shown in FIG. 2C, the bottom cover may define a knob engagement protrusion 610 that extends outwardly through the band teeth 160 of the head band 150 (e.g., through both head band end 150A and head band end 150B). As seen in the exploded view of FIGS. 2A and 2B, as well as assembled in the side view of FIG. 2D, the top cover 120 may couple to the bottom cover 130, such that the band 150 may be sandwiched therebetween. Additionally, a ratchet gear 140 may be disposed on the knob engagement protrusion 610. In various embodiments, the knob 110 may also be disposed on the knob engagement protrusion 610 and also configured to engage with the ratchet gear 140. In various embodiments, the knob 110 engagement with the knob engagement protrusion 610 may cause the ratchet mechanism to stay a unitary piece.

In various embodiments, the ratchet gear 140 may define one or more ratchet gear teeth 700 configured to be received by the band teeth 160 of the head band 150. In various embodiments, the head band 150 may define two ends 150A, 150B, configured to be received between the band housing (e.g., top cover 120 and bottom cover 130). As such, as the ratchet gear teeth 700 of the ratchet gear 140 rotates within the band teeth 160, the two ends 150A, 150B of the head band 150 may be configured to either enlarge or reduce the circumference of the head band 150. For example, in an instance in which the ratchet gear 140 rotates clockwise, the amount of overlap between the two ends 150A, 150B may increase causing the head band circumference to reduce (e.g., head band is tightened), while in an instance in which the ratchet gear 140 rotates counterclockwise, the overlap of the two ends 150A, 150B of the head band 150 may be reduce and therefore the head band circumference may be increased (e.g., head band is loosened).

In various embodiments, the top cover 120 may define a teeth ring 410 configured to engage with one or more tooth protrusions of the ratchet gear, as discussed with reference to FIG. 4 below. In various embodiments, the rotational movement of the ratchet gear 140 may be restricted in a direction via the engagement of the teeth ring 410 of the top cover 120 and the tooth protrusion(s) of the ratchet gear 140. In various embodiments, and as discussed in more detail in reference to FIG. 3 below, the tooth protrusion(s) may be disengaged from the teeth ring 410 of the top cover 120 based on the rotation of the knob 110 due to the interaction between a plurality of knob protrusions (e.g., 200A) and the hooking mechanisms (e.g. 220A shown in FIG. 4) of the ratchet gear 140.

Figure 2D:
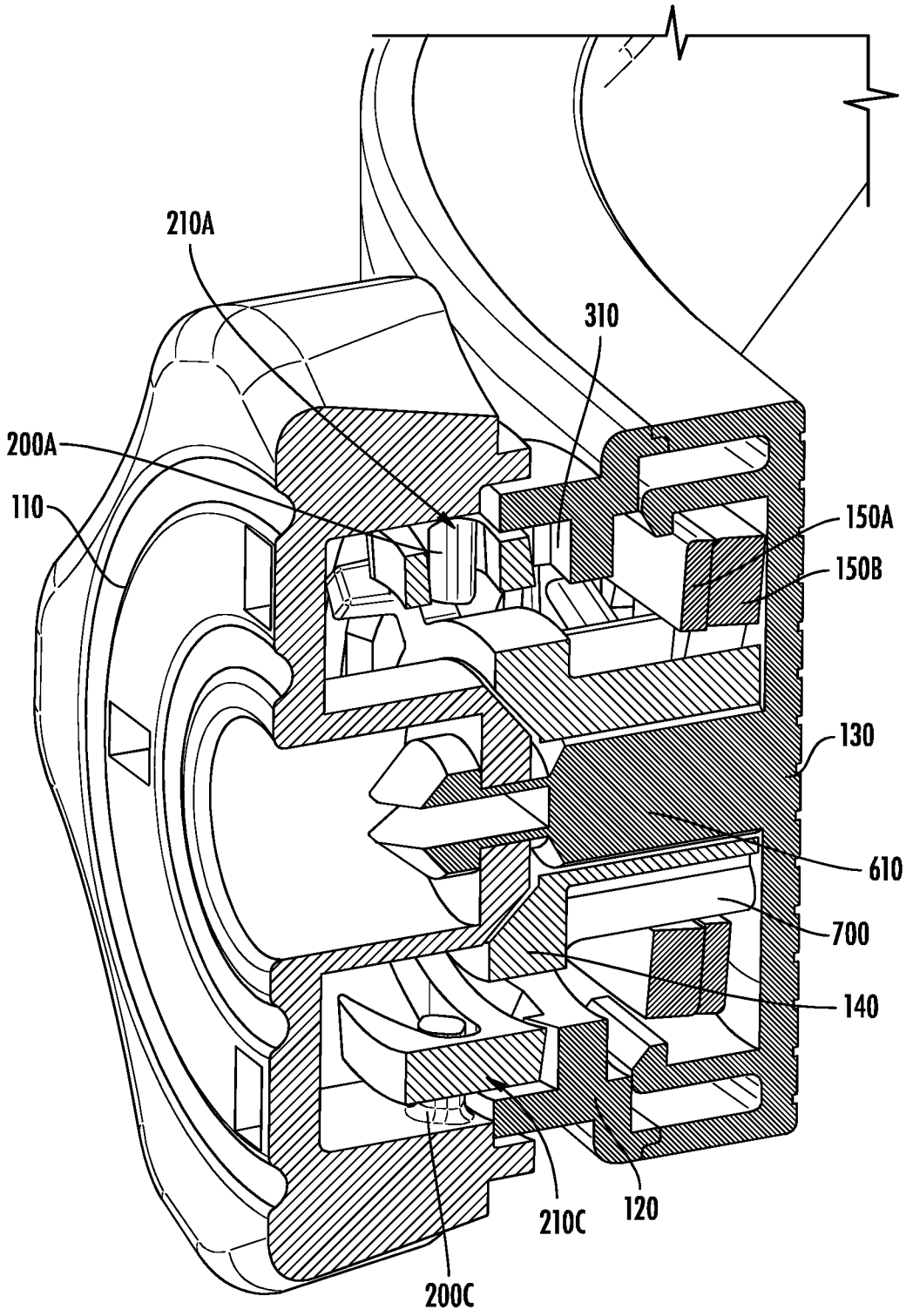
FIG. 2D is a cut-away side view of the ratchet mechanism installed on a head band in accordance with an example embodiment of the present disclosure.
Figure 3A:
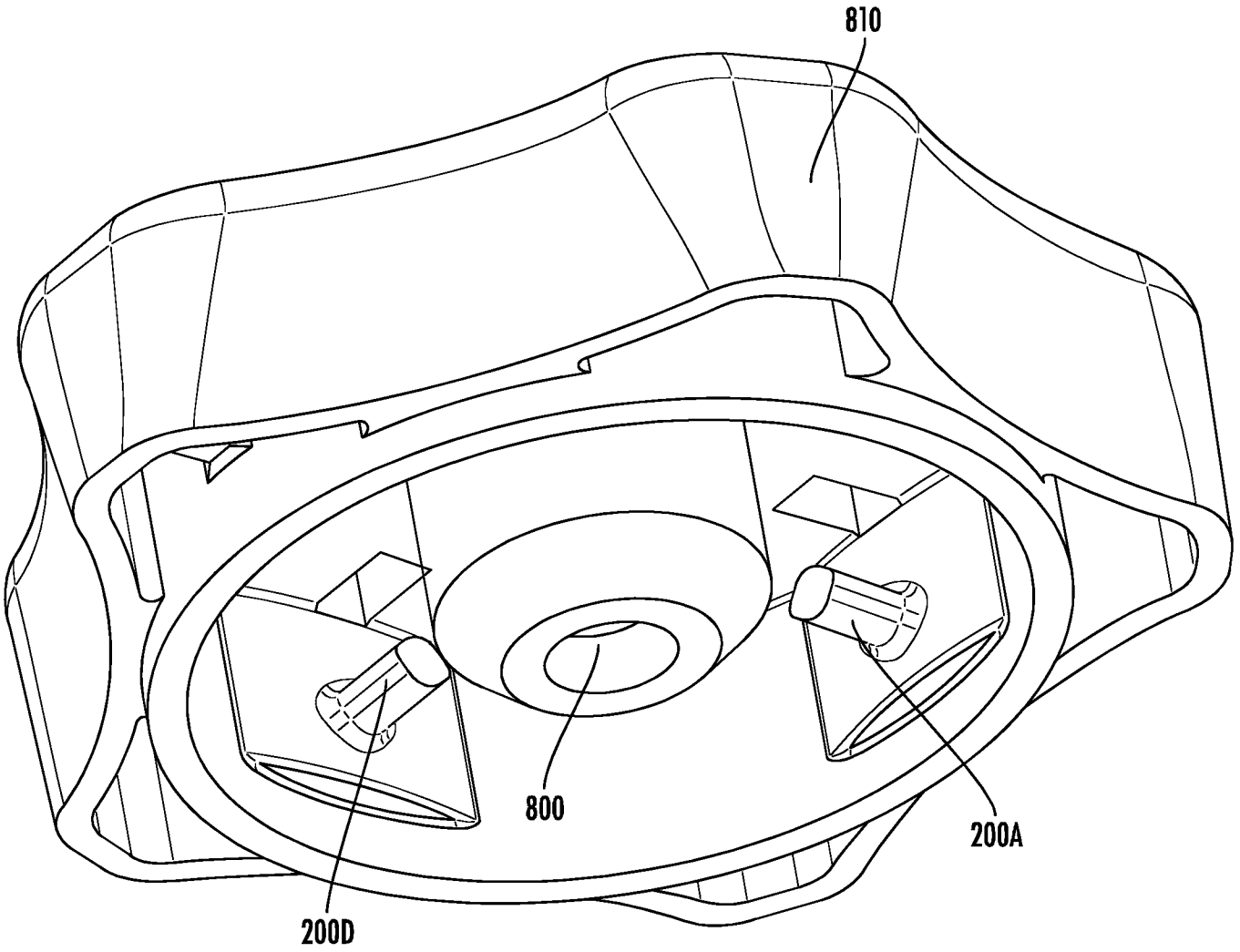
FIG. 3A illustrates the knob used in the ratchet mechanism in accordance with an example embodiment of the present disclosure.
Figure 8A:
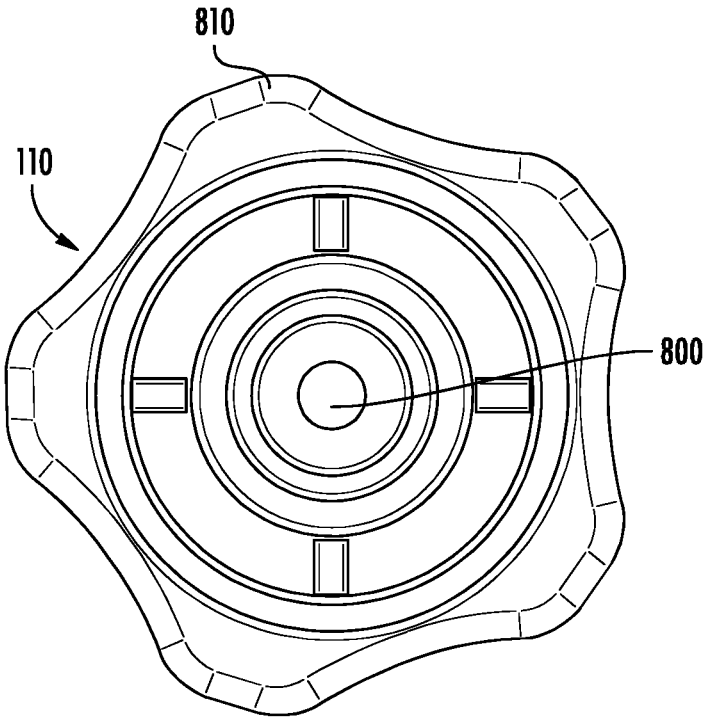
FIGS. 8A-8C illustrate various view of the knob used in the ratchet mechanism in accordance with an example embodiment of the present disclosure.
Figure 8B:
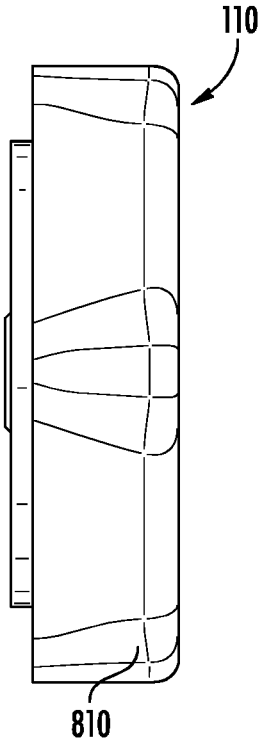
Figure 8C:
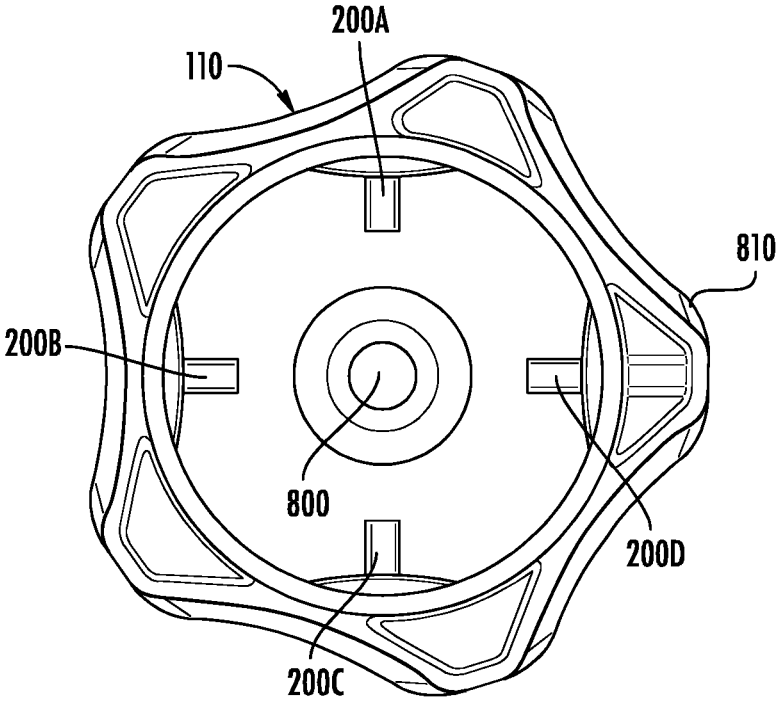

FIG. 3A illustrates a knob of an example embodiment. As shown, the knob 110 includes a plurality of knob protrusions 200A-200D (shown in more detail in FIG. 8C below). In various embodiments, the knob protrusions 200A-200D may be spaced equally from one another. For example, as shown in FIG. 8C below, four knob protrusions 200A-200D may be provided approximately 90 degrees from one another. In some embodiments, the same number of knob protrusions may be provided as the number of teeth engagement mechanisms provided on the ratchet gear 140. In various embodiments, the knob 110 In various embodiments, the knob 110 may also be configured with a knob aperture 800 configured to engage with the knob engagement protrusion 610 of the bottom cover 130 (e.g., via a snap fit as shown in FIG. 2D). In various embodiments, the knob 110 may be configured for a user to rotate via engagement protrusions 810. In various embodiments, the number of engagement protrusions provided may be based on the desired gripping characteristics. For example, as shown, the knob 110 may have five engagement protrusions 810.

Figure 3B:
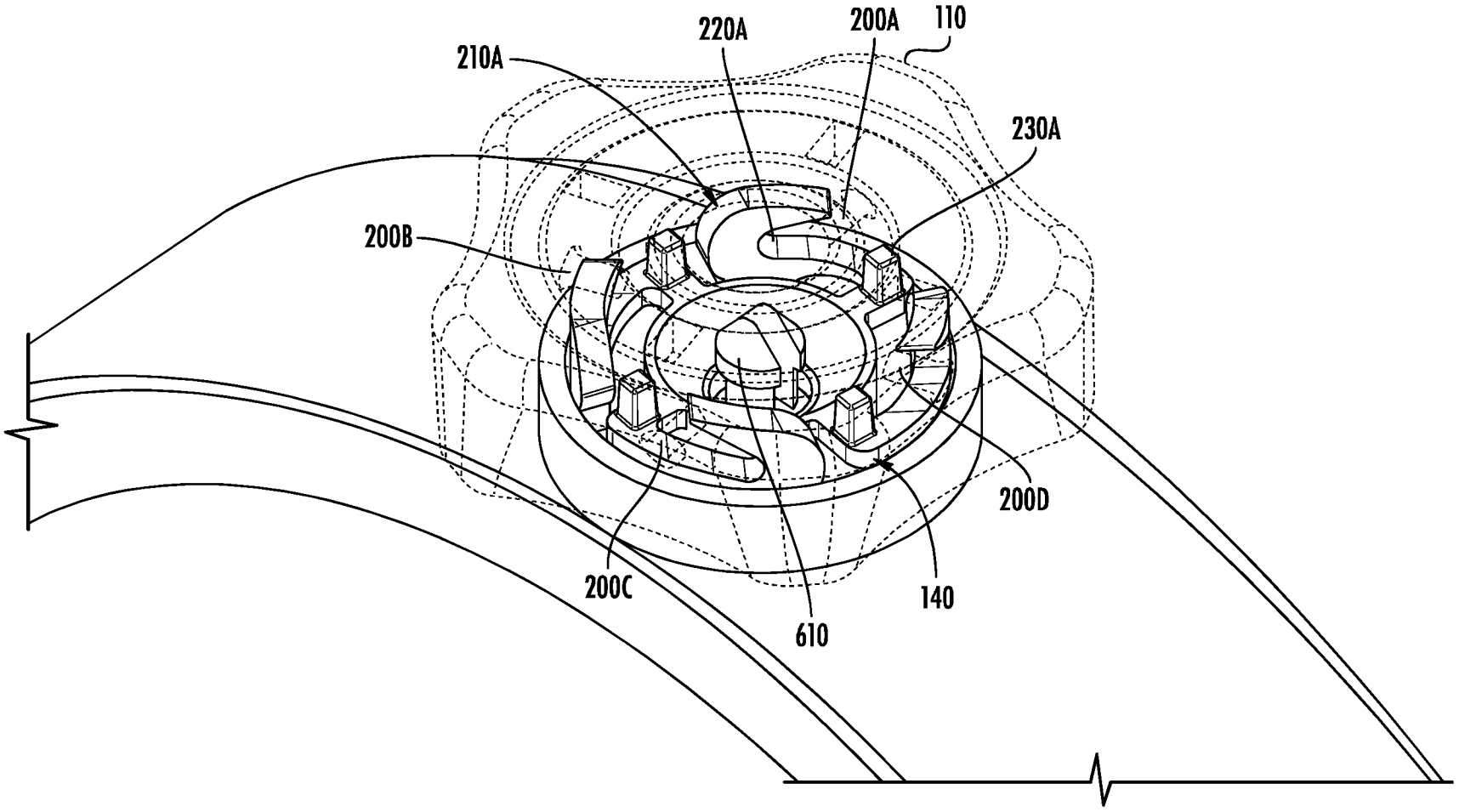
FIG. 3B illustrates the interaction between a knob and a ratchet gear of the ratchet mechanism in accordance with an example embodiment of the present disclosure.

FIG. 3B illustrates the interaction between the knob of FIG. 3A and a ratchet gear of the ratchet mechanism in accordance with an example embodiment. As shown, a ratchet gear 140 may be disposed under the knob 110. As discussed above, in various embodiments the knob 110 may have one or more knob protrusions 200A-200D that are configured to engage with the ratchet gear 140. In various embodiments, the ratchet gear 140 may be configured to engage with the band housing (e.g., top cover 120 and the bottom cover 130). In various embodiments, the ratchet gear 140 may be configured with a plurality of teeth engagement mechanisms (e.g., the embodiment shown in FIG. 3 has four teeth engagement mechanisms 210A-210D). In various embodiments, each teeth engagement mechanism 210A-210D may include a hooking mechanism 220A-220D configured to receive the knob protrusion 200A-200D. In various embodiments, each teeth engagement mechanism 210A-210D may include a stopping protrusion 230A-230D positioned opposite the hooking mechanism 220A-220D, such that a knob protrusion travel area is defined between a given stopping protrusion (e.g., stopping protrusion 230A) and a hooking mechanism (e.g., hooking mechanism 220A) on each teeth engagement mechanism (e.g., teeth engagement mechanism 210A.

During various embodiments, the knob protrusion (e.g., knob protrusions 200A-200D) may be configured to travel between a first position and a second position along the knob protrusion travel area, such that in the embodiment shown in FIG. 3B, as the knob 110 moves in a first direction (e.g., the clockwise direction), each knob protrusions 200A-200D may move towards a first position, defined as an instance in which a given knob protrusion 200A-200D engages with the respective stopping protrusion 230A-230D. For example, in an instance in which the knob 110 is rotated in the first direction (e.g., the clockwise direction), a given knob protrusion 200A-200D travels along the knob protrusion travel area until the given knob protrusion 200A-200D engages with the respective stopping protrusion 230A-230D causing the ratchet gear 140 rotate in the first direction (e.g., clockwise direction). In some embodiments, the teeth ring 410 may be configured such that the teeth ring 410 provides little to no resistance to motion of the ratchet gear in the first direction (e.g., the clockwise direction, which would tighten the head band). Alternatively, in an instance in which the knob 110 is rotated in a second direction (e.g., the counterclockwise direction), each knob protrusion 200A-200D may move towards a second position, defined as an instance in which a given knob protrusion 200A-200D engages with the respective hooking mechanism 220A-220D. For example, in an instance in which the knob 110 is rotated in the second direction (e.g., knob protrusion travel area), a given knob protrusion 200A-200D travels along the knob protrusion travel area until the given knob protrusion 200A-200D engages with the respective hooking mechanism 220A-220D causing the ratchet gear 140 to rotate in the second direction (e.g., the counterclockwise direction). In such an embodiment, the rotation of the ratchet gear 140 in the second direction may cause the one or more tooth protrusions 300A-D to engage with a tooth of the top cover (e.g., teeth ring 410) as shown and discussed in reference to FIG. 4, such that the teeth ring 410 provides resistance to the motion of the ratchet gear 140 in the second direction. As such, in an instance in which a sufficient force is applied to the rotation of the knob 110 in the second direction, the engagement of the knob protrusions 200A-200D with the hooking mechanisms 220A-220D may cause the one or more tooth protrusions 300A-300D to overcome the engagement force of the one or more teeth of the teeth ring 410, such that the ratchet gear rotates in the second direction (e.g., the counterclockwise direction).

Figure 4:
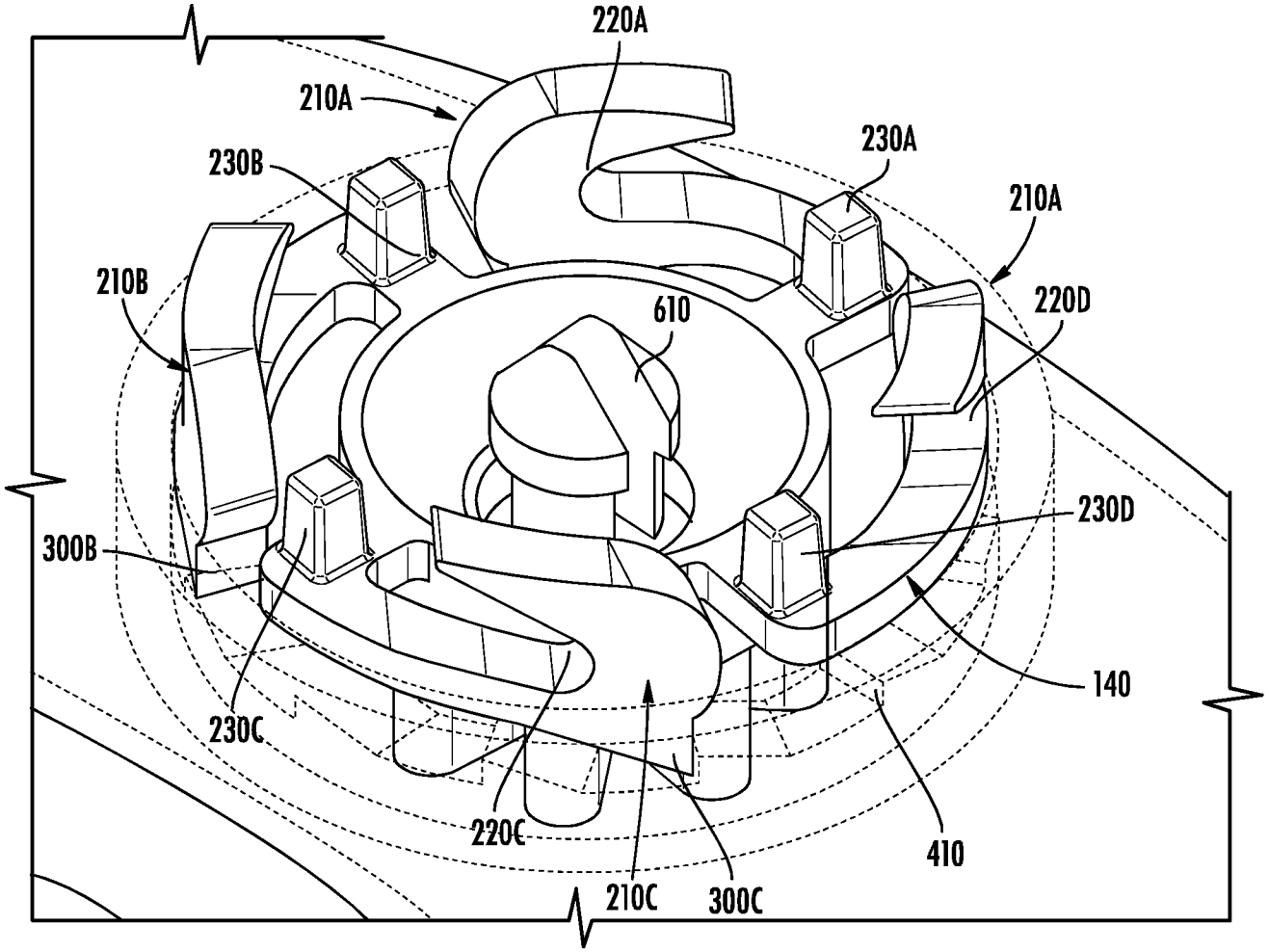
FIG. 4 illustrates the interaction between the ratchet gear and a teeth ring of a top cover of the ratchet mechanism in accordance with an example embodiment of the present disclosure.
Figure 5A:
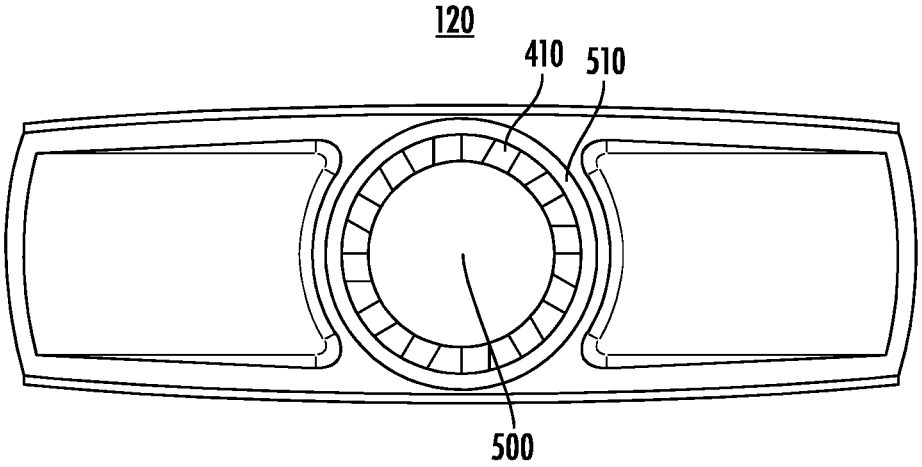
FIGS. 5A-5D illustrate various view of the top cover used in the ratchet mechanism in accordance with an example embodiment of the present disclosure.
Figure 5B:
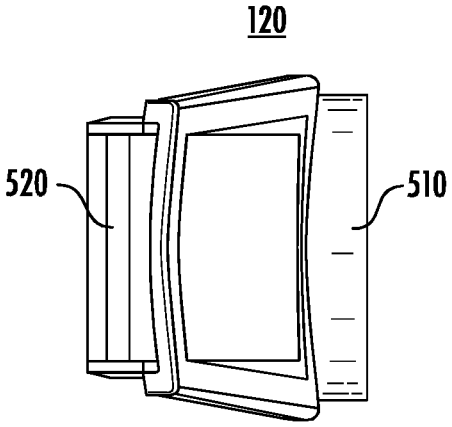
Figure 5C:
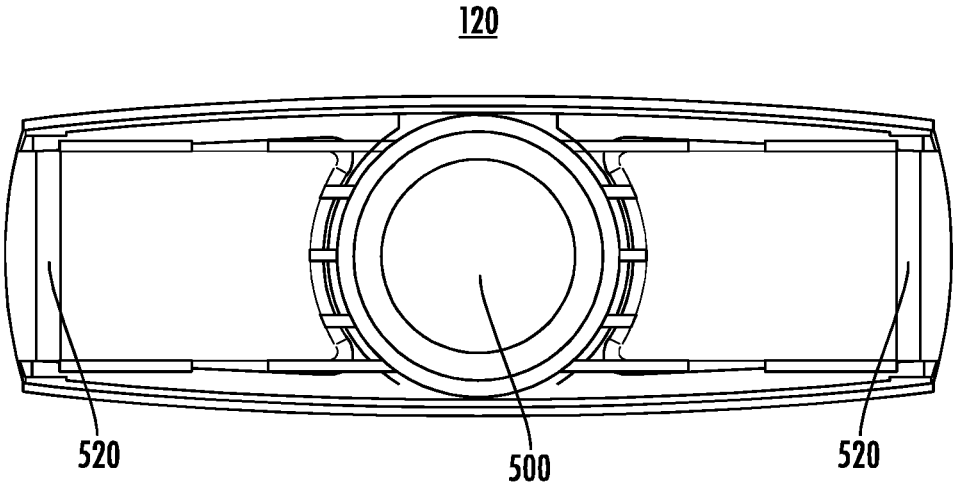
Figure 5D:
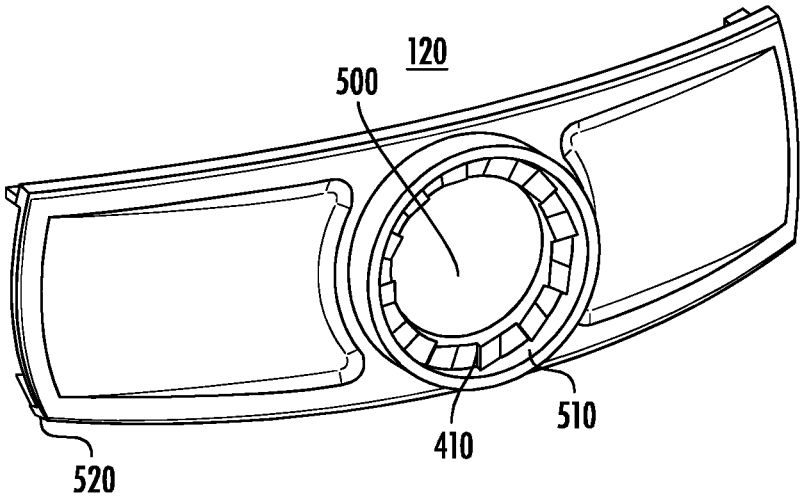
Figure 6A:
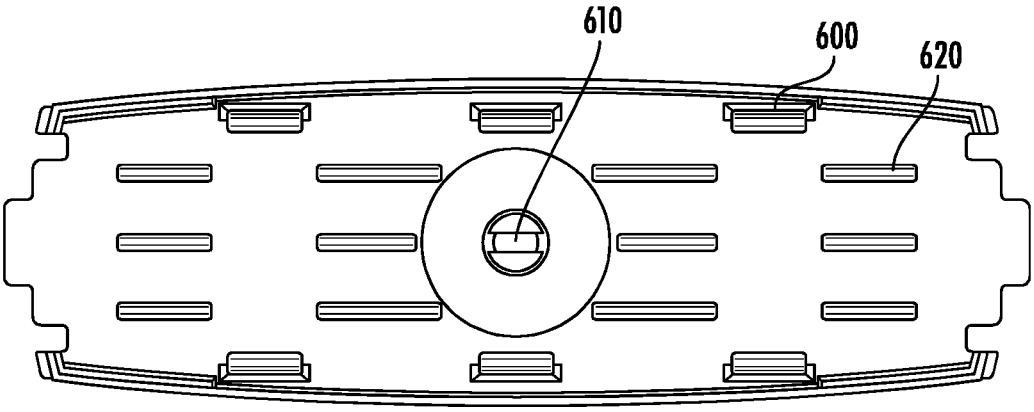
FIGS. 6A-6D illustrate various view of the bottom cover used in the ratchet mechanism in accordance with an example embodiment of the present disclosure.
Figure 6B:
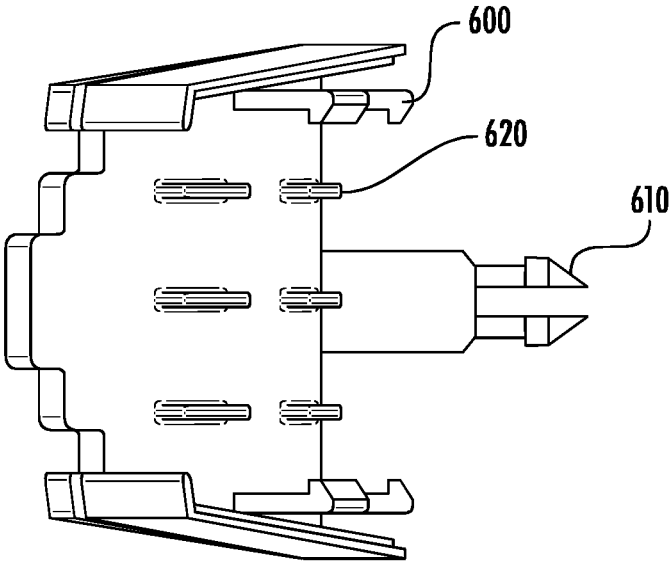
Figure 6C:
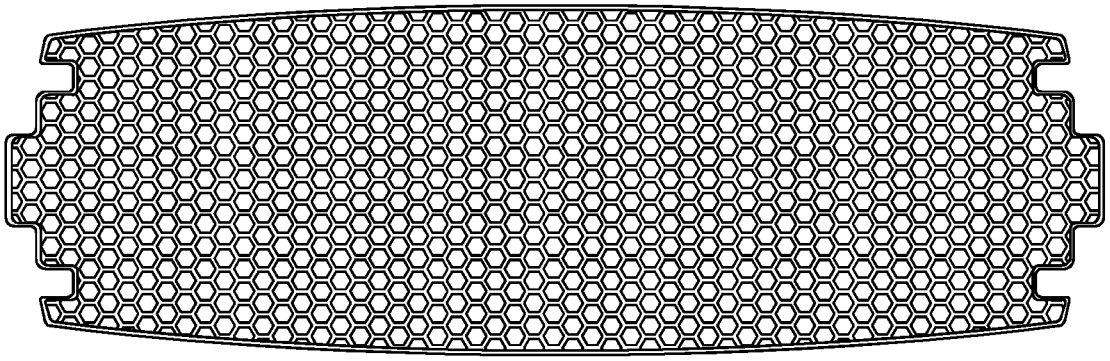
Figure 6D:
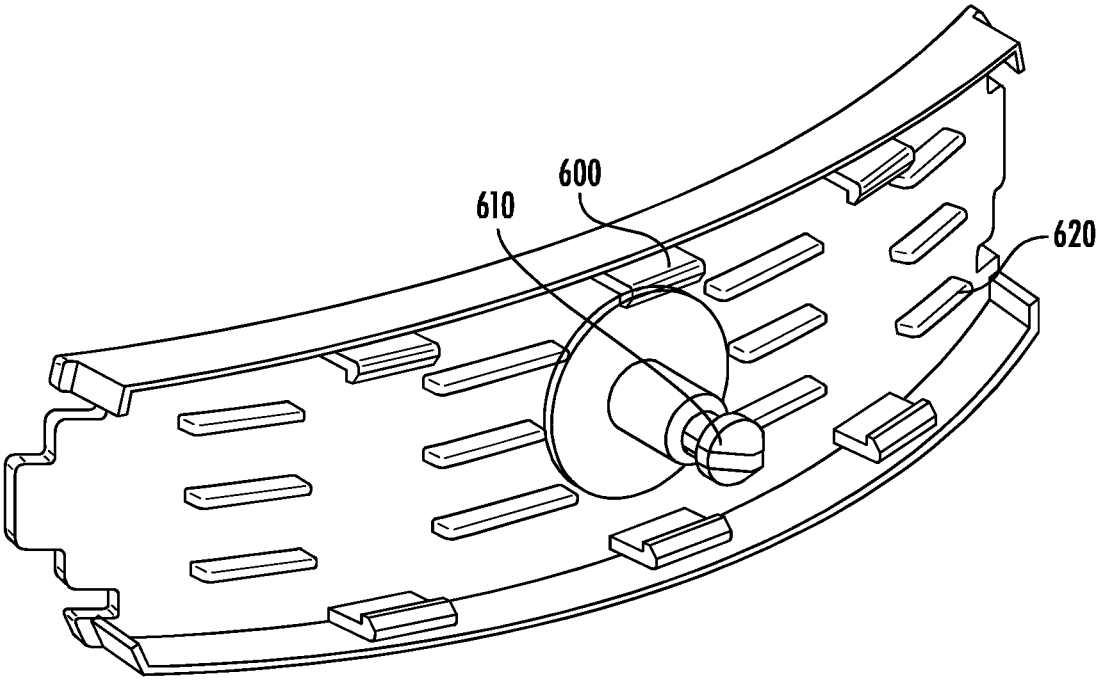
Figure 7A:
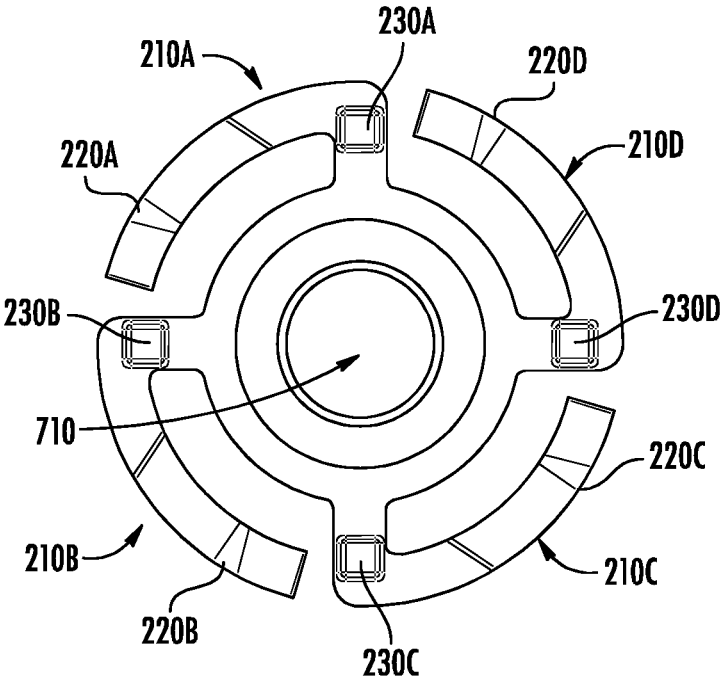
FIGS. 7A-7D illustrate various view of the ratchet gear used in the ratchet mechanism in accordance with an example embodiment of the present disclosure.
Figure 7B:
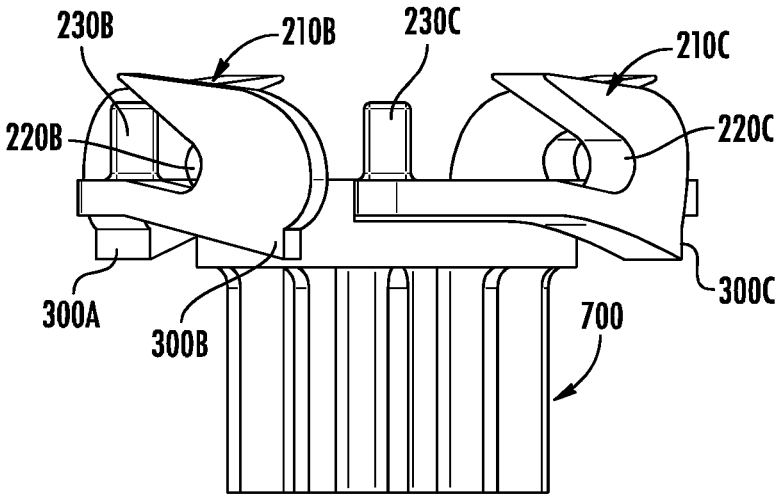
Figure 7C:
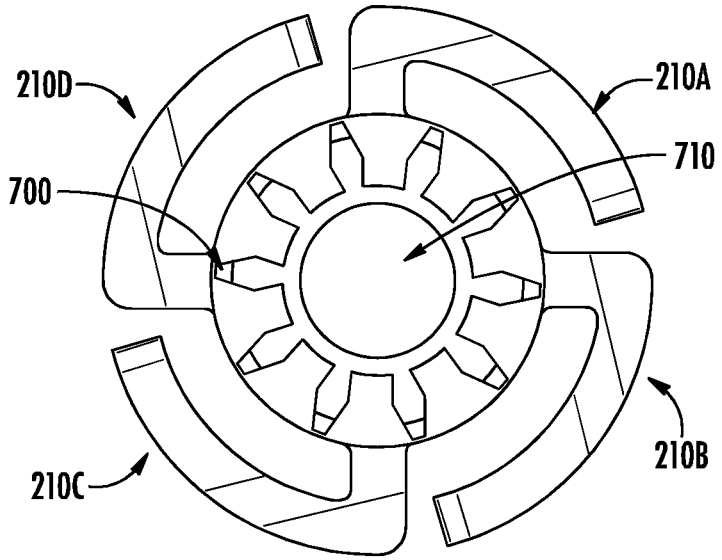
Figure 7D:
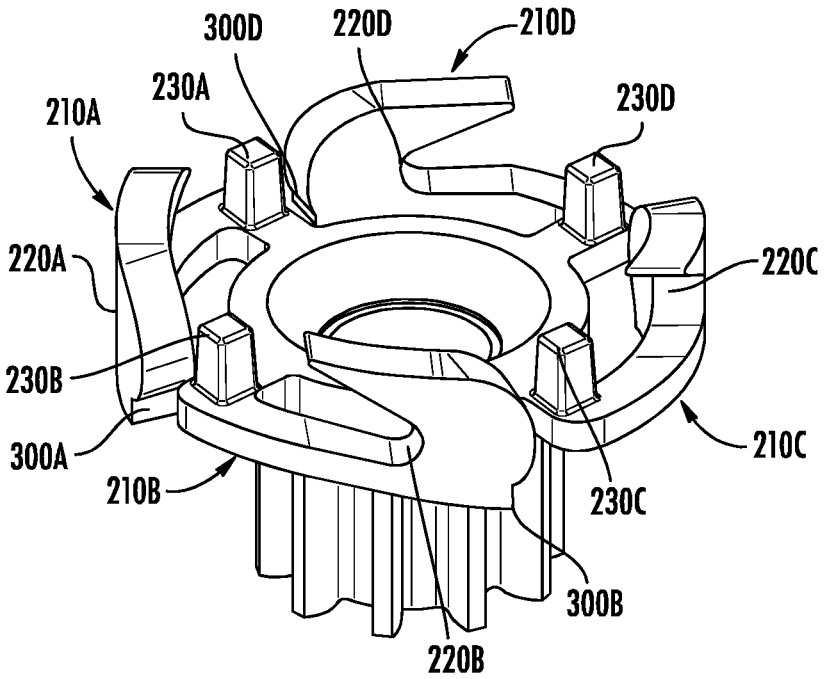

FIG. 4 illustrates the interaction between the ratchet gear and a teeth ring of a top cover of the ratchet mechanism by showing the ratchet mechanism without the knob 110 and with a transparent view of the top cover 120 in accordance with an example embodiment. In various embodiments, each respective teeth engagement mechanisms 120A-120D may include a tooth protrusion (e.g., tooth protrusions 300B and 300C are shown). In various embodiments, the top cover 120 may include a teeth ring 410 configured with one or more teeth configured to engage with the tooth protrusions of the ratchet gear 140. In various embodiments, the teeth of the teeth ring 410 may be defined as a ramped surface. In various embodiments, the teeth of the teeth ring 410 may be configured around the ratchet gear aperture, such that the lower portion of the ramped surface of one tooth abuts a higher portion of the ramped surface of another tooth. In various embodiments, the teeth ring 410 may be configured to engage a tooth protrusion (e.g., tooth protrusion 300C) in an instance in which the ratchet gear 140 is moving in a single direction (e.g., counterclockwise). In such an embodiment, the ratchet gear 140 may be configured to rotate in the opposite direction (e.g., clockwise) with minimal resistance by the teeth ring 410. As discussed above, the restriction of the ratchet gear 140 due to the interaction between the teeth ring 410 and tooth protrusion(s) may restrict the movement of the ratchet gear teeth 700 within the band teeth 160. For example, in an instance in which the ratchet gear 140 is restricted from rotating counterclockwise, the ratchet gear teeth 700 may also be restricted from rotating counterclockwise, such that the head band cannot be loosened until the tooth protrusion(s) are disengaged from the teeth ring 410 (e.g., via a user rotating the knob 110).

In various embodiments, the ratchet mechanism 100 may be configured such that rotation direction of the knob 110 and ratchet gear 140 in which the tooth protrusions 300A-300D engages with the teeth ring 410 (e.g., the counterclockwise direction) may be the rotational direction for loosening the band. In various embodiments, the engagement of the tooth protrusions 300A-300D and the teeth ring 410A-410D may configured to be overcome with sufficient rotational force. For example, a user may be able to rotate the knob 110 in the loosening direction (e.g., counterclockwise) with sufficient force to overcome the engagement force between the tooth protrusions 300A-300D and the teeth ring 410, such that the tooth protrusions 300A-300D may disengage from the teeth ring 410 and rotate to allow the ratchet mechanism to loosen the band.

FIGS. 5A-5D illustrate various view of the top cover used in the ratchet mechanism in accordance with an example embodiment. As shown, the top cover 120 may have a ratchet gear aperture 500 configured to receive the ratchet gear 140 as discussed herein. In various embodiments, the teeth ring 410 discussed in FIG. 4 may be defined around the ratchet gear aperture 500 on the top of the top cover 120 (e.g., towards the direction in which the knob 110 may be installed). In various embodiments, the top cover 120 may define a teeth ring lip 510 configured to keep the tooth protrusions 300A-300D within the teeth ring 410 during operation. In various embodiments, the top cover 120 may define a curved shaped, such as complementing the bottom cover 130 as discussed in reference to FIGS. 6A-6D. In various embodiments, the top cover 120 may define a band receiver 520 as one or more both ends of the top cover, such that the band, when inserted in the band cavity, passes through the band receivers 520.

FIGS. 6A-6D illustrate various view of the bottom cover used in the ratchet mechanism in accordance with an example embodiment. In various embodiments, the bottom cover 130 may be configured with a curved shape, such as to engage a user's head more effectively and/or comfortably. In various embodiments, the bottom cover 130 may include a plurality of snap fits 600 configured to operably couple the top cover 120 with the bottom cover 130. Additionally, in some embodiments, the bottom cover 130 may include a plurality of gripping protrusions 620 extending towards the top cover and configured to engage with the band during operation (e.g., to assist in restricting any accidental movement of the bands during operation). In various embodiments, the bottom cover 130 may include a knob engagement protrusion 610 configured to extend through the ratchet gear aperture 500, receive the ratchet gear 140, also secure the knob 110. In various embodiments, the knob 110 may be configured to snap fit to the knob engagement protrusion 610, such that the non-rotational movement of the knob 110 is limited. In various embodiments, the band may be configured to receive the knob engagement protrusion 610, such that the band is held in the band cavity in part due to the knob engagement protrusion. In various embodiments, the bottom cover 130 may define a surface (FIG. 6C) to engage with a user's head during operation.

FIGS. 7A-7D illustrate various view of the ratchet gear used in the ratchet mechanism in accordance with an example embodiment. In various embodiments, the teeth engagement mechanisms 210A-210D are more clearly shown. In various embodiments, the number of teeth engagement mechanisms may be based on the desired amount of resistance provided to rotation in the loosening direction. For example, more teeth engagement mechanisms may provide more resistance to rotational movement of the ratchet gear 140 in the loosening direction (e.g., counterclockwise). In various embodiments, the ratchet gear 140 may also include a plurality of ratchet gear teeth 700 configured to ratchetably engage with the band as discussed herein. For example, the ratchet gear teeth 700 may engage with the band teeth 160 of the head band 150, such that the rotation of the ratchet gear 140 results in increasing or decreasing the amount of overlap between the two ends 150A, 150B of the head band. In various embodiments, the ratchet gear 140 may define a gear aperture 710, configured to receive the knob engagement protrusion 610 of the bottom cover 130, such that any non-rotational movement is restricted.

FIGS. 8A-8D illustrate various view of the knob used in the ratchet mechanism in accordance with an example embodiment. As shown, the knob 110 includes a plurality of knob protrusions 200A-200D. In various embodiments, the knob protrusions 200A-200D may be spaced equally from one another. For example, as shown in FIG. 8C, four knob protrusions 200A-200D may be provided approximately 90 degrees from one another. In some embodiments, the same number of knob protrusions may be provided as the number of teeth engagement mechanisms provided on the ratchet gear 140. For example, as shown in the FIG. 3, the knob 110 may have four knob protrusions 200A-200D in an instance in which the ratchet gear 140 may have four teeth engagement mechanisms 210A-210D.

In various embodiments, the teeth engagement mechanisms 210A-210D may be equally spaced from one another. In various embodiments, the hooking mechanisms 220A-220D may be positioned such that all knob protrusions 200A-200D may engage with the respective hooking mechanism 220A-220D at approximately the same time during counterclockwise rotation. In various embodiments, the knob 110 may also be configured with a knob aperture 800 configured to engage with the knob engagement protrusion 610 of the bottom cover 130 (e.g., via a snap fit). In various embodiments, the knob 110 may be configured for a user to rotate via engagement protrusions 810.

Figure 9:
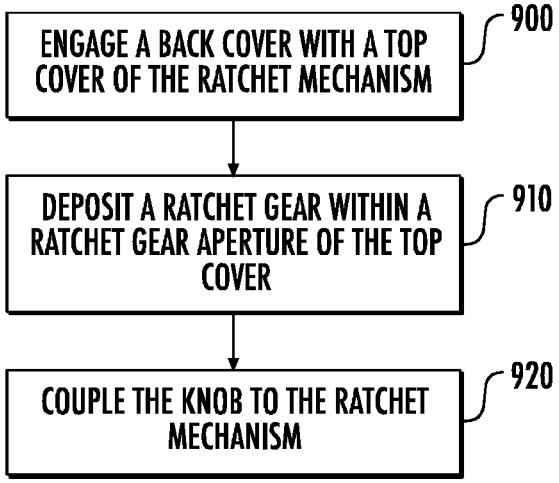
FIG. 9 is a flow chart illustrating the method of assembling the ratchet mechanism in accordance with an example embodiment of the present disclosure.

FIG. 9 is a flow chart illustrating the method of assembling the ratchet mechanism in accordance with an example embodiment of the present disclosure. Referring now to Block 900 of FIG. 9, the method of assembling the ratchet mechanism may include engaging a back cover with a top cover of the ratchet mechanism (e.g., to form a band housing). As discussed, the top cover 120 and bottom cover 130 may be configured to snap fit with one another such that the band cavity is defined. The top cover 120 may define a knob engagement protrusion 610 that is configured to extend beyond the ratchet gear aperture 500 of the top cover 120. In various embodiments, the teeth ring 410 may be provided on the top cover 120 on the opposite side of the top cover from which the bottom cover 130 is attached, such that the teeth ring 410 and teeth ring lip 510 does not extend into the band cavity. In various embodiments, the top cover 120 and the bottom cover 130 are configured to allow a band to ratchetably move within the band cavity defined between the top cover and the back cover. In various embodiments, the band housing may also be a unitary piece, such that the top cover 120 and the bottom cover 130 do not detach from one another.

Referring now to Block 910 of FIG. 9, the method may include depositing a ratchet gear within a ratchet gear aperture of the top cover. In various embodiments, the ratchet gear aperture 710 of the ratchet gear 140 may receive the knob engagement protrusion 610. In various embodiments, the ratchet gear 140 may be positioned such that the tooth protrusions 300A-300D may be movably engaged with the teeth ring 410. In various embodiments, the ratchet gear teeth 700 are configured to engage with the band teeth 160 of the band 150, Referring now to Block 920 of FIG. 9, the method includes coupling the knob to the ratchet mechanism. As discussed above, the knob 110 may define a knob aperture 800 configured to receive the knob engagement protrusion 610 (e.g., the knob 110 may snap fit to the knob engagement protrusion 610). In some embodiments, the knob includes a plurality of knob protrusions with each knob protrusion being configured to be placed within the respective knob protrusion travel defined between the hooking mechanism 220A-220D and the stopping protrusion 230A-230D. In various embodiments, the knob protrusions 200A-200D may be positioned within the respective knob protrusion travel by passing the knob protrusion through the opening between the respective hooking mechanism 220A-220D and stopping protrusion 230A-230D. In various embodiments, the ratchet mechanism 100 may be configured such that the knob protrusions 200A-200D may be within the knob protrusion travel in an instance in which the knob is operably coupled with the knob engagement protrusions 610.

In an example assembly condition, the knob 110 may be configured to have the knob protrusions 220A-200D may be positioned within the knob provision travel. During operation, in an instance the knob 110 is rotated in the clockwise direction, the knob protrusions 220A-220D rotate towards the stopping protrusions 230A-D until each knob protrusion 220A-220D engages each stopping protrusion and the movement of the ratchet gear 140 causes the band to tighten. At which point, one or more tooth protrusions 300A-300C may engage with the teeth ring 410, such that no unintended counterclockwise rotation may occur with a sufficient force, such that the band is not loosened accidentally during operation. As such, in an instance in which the knob 110 is rotated in the counterclockwise direction with sufficient force, each tooth protrusion 300A-300D may disengage with the teeth ring 410 to allow the band to loosen. For example, in an instance a user intends to loosen the band 150, the user may turn the knob 110 in the counterclockwise direction until the knob protrusions 200A-200D engage with the hooking mechanism 220A-220D counteracts the force of the teeth ring 410 on the tooth protrusion 300A-300D, such that the ratchet gear 140 rotates in the counterclockwise direction and the band is loosened.

It must be noted that, as used in this specification and the appended claims, the singular forms "a," "an," and "the" include plural referents unless the content clearly dictates otherwise.

References within the specification to "one embodiment," "an embodiment," "embodiments", or "one or more embodiments" are intended to indicate that a particular feature, structure, or characteristic described in connection with the embodiment is included in at least one embodiment of the present disclosure. The appearance of such phrases in various places within the specification are not necessarily all referring to the same embodiment, nor are separate or alternative embodiments mutually exclusive of other embodiments. Further, various features are described which may be exhibited by some embodiments and not by others. Similarly, various requirements are described which may be requirements for some embodiments, but not other embodiments.

It should be noted that, when employed in the present disclosure, the terms "comprises," "comprising," and other derivatives from the root term "comprise" are intended to be open-ended terms that specify the presence of any stated features, elements, integers, steps, or components, and are not intended to preclude the presence or addition of one or more other features, elements, integers, steps, components, or groups thereof.

As required, detailed embodiments of the present disclosure are disclosed herein; however, it is to be understood that the disclosed embodiments are merely exemplary, which may be embodied in various forms. Therefore, specific structural and functional details disclosed herein are not to be interpreted as limiting, but merely as a basis for the claims and as a representative basis for teaching one skilled in the art to variously employ the present disclosure in virtually any appropriately detailed structure.

While it is apparent that the illustrative embodiments herein disclosed fulfill the objectives stated above, it will be appreciated that numerous modifications and other embodiments may be devised by one of ordinary skill in the art. Accordingly, it will be understood that the appended claims are intended to cover all such modifications and embodiments, which come within the spirit and scope of the present disclosure.

What is claimed is:

1. A ratchet mechanism for a hard hat, the ratchet mechanism comprising:

a knob with a plurality of knob protrusions, wherein the plurality of knob protrusions comprises four knob protrusions that are positioned 90 degrees from one another;

a ratchet gear; and a band housing configured to allow a band to ratchetably move within the band housing, the band housing comprising:

a knob engagement protrusion; and a ratchet gear aperture configured with one or more teeth surrounding the ratchet gear aperture, the teeth defining a ramped surface, wherein the ratchet gear is disposed on the knob engagement protrusion and the ratchet gear further comprises one or more ratchet gear teeth configured to engage with a set of band teeth on the band, such that a rotation of the ratchet gear tightens or loosens the band during operation.

2. The ratchet mechanism of claim 1, wherein the ratchet gear comprises a plurality of teeth engagement mechanisms, each teeth engagement mechanism comprising a hooking mechanism and a tooth protrusion, wherein each hooking mechanism is configured to engage with one of the plurality of knob protrusions.

3. The ratchet mechanism of claim 2, wherein each tooth protrusion is configured to engage with one of the one or more teeth of the band housing in an instance in which the ratchet gear is rotated in a specific direction, such that the rotation of the ratchet gear is restricted in an instance in which at least one tooth protrusion is engaged.

4. The ratchet mechanism of claim 3, wherein each of the teeth engagement mechanism defines a knob protrusion travel area defined between the hooking mechanism and a stopping protrusion, wherein each of the knob protrusions are configured to move within a respective knob protrusion travel area during operation of the ratchet mechanism.

5. The ratchet mechanism of claim 4, wherein each knob protrusion defines a first position within the knob protrusion travel area and a second position within the knob protrusion travel area, wherein at the first position the knob protrusion engages with the stopping protrusion, such that the ratchet gear is rotated in a first direction, and wherein at the second position the knob protrusion engages with the hooking mechanism, such that the ratchet gear is rotated in a second direction and one or more tooth protrusions are disengaged from the one or more teeth surrounding the ratchet gear aperture.

6. The ratchet mechanism of claim 1, wherein each of the plurality of knob protrusions are equally spaced from one another.

7. The ratchet mechanism of claim 1, wherein the band housing is configured to receive two ends of the band, such that the ratchet mechanism is configured to retract one or more ends of the band.

8. The ratchet mechanism of claim 1, wherein the one or more teeth are configured around the ratchet gear aperture, such that a lower portion of the ramped surface of one tooth abuts a higher portion of the ramped surface of another tooth.

9. The ratchet mechanism of claim 1, wherein a tooth protrusion of the ratchet gear is configured to disengage with the teeth of the band housing in an instance a sufficient rotational force is provided.

10. The ratchet mechanism of claim 1, wherein the rotation of the ratchet gear teeth loosen or tighten the band based on the rotational direction of the ratchet gear, and wherein the rotation of the ratchet gear teeth in at least one direction is restricted in an instance in which at least one tooth protrusion is engaged with the one or more teeth of the band housing.

11. The ratchet mechanism of claim 1, wherein each of the plurality of knob protrusions extend inward.

12. The ratchet mechanism of claim 1, wherein the ratchet gear comprises a plurality of teeth engagement mechanisms, wherein a hooking mechanism and a tooth protrusion of each of the plurality of teeth engagement mechanisms extend away from each other.

13. The ratchet mechanism of claim 12, wherein each of the plurality of teeth engagement mechanisms comprises a stopping protrusion that extends away from a body of the teeth engagement mechanism.

14. The ratchet mechanism of claim 13, wherein the stopping protrusion, the hooking mechanism, and the tooth protrusion of each of the plurality of teeth engagement mechanisms are configured to rotate in unison.

15. The ratchet mechanism of claim 14, wherein each tooth protrusion is configured to engage with one of the one or more teeth of the band housing in an instance in which the ratchet gear is rotated in a specific direction, such that the rotation of the ratchet gear is restricted in an instance in which at least one tooth protrusion is engaged.

16. The ratchet mechanism of claim 15, wherein each of the teeth engagement mechanism defines a knob protrusion travel area defined between the hooking mechanism and the stopping protrusion, wherein each of the knob protrusions are configured to move within a respective knob protrusion travel area during operation of the ratchet mechanism.

17. The ratchet mechanism of claim 16, wherein each knob protrusion defines a first position within the knob protrusion travel area and a second position within the knob protrusion travel area, wherein at the first position the knob protrusion engages with the stopping protrusion, such that the ratchet gear is rotated in a first direction, and wherein at the second position the knob protrusion engages with the hooking mechanism, such that the ratchet gear is rotated in a second direction and one or more tooth protrusions are disengaged from the one or more teeth surrounding the ratchet gear aperture.

18. A method of assembling a ratchet mechanism for a hard hat, the method comprising:

allowing a band to ratchetably move within a band housing;

depositing a ratchet gear within a ratchet gear aperture, the ratchet gear comprising a plurality of teeth engagement mechanisms, each teeth engagement mechanism having a hooking mechanism and a tooth protrusion;

engaging the hooking mechanism with one of a plurality of knob protrusions of a knob, wherein the plurality of knob protrusions comprises four knob protrusions positioned 90 degrees from one another; and coupling the knob to the ratchet mechanism.

19. The method of claim 18, wherein the band housing comprises a knob engagement protrusion and the ratchet gear aperture configured with one or more teeth surrounding the ratchet gear aperture, the teeth defining a ramped surface.

20. The method of claim 19, wherein each tooth protrusion engages with one of the one or more teeth of the band housing when the ratchet gear is rotated is a specific direction.

21. The method of claim 20, wherein the ratchet gear is disposed on the knob engagement protrusion.

22. The method of claim 18, wherein each knob protrusion moves within a knob protrusion travel area during the operation of the ratchet mechanism.

23. The method of claim 18, wherein the band housing receives two ends of the band.

24. The method of claim 23, wherein the ratchet mechanism retracts one or more ends of the band.

* * * * *